US005778977A

United States Patent [19]

Bowzer et al.

[11] Patent Number: 5,778,977

[45] Date of Patent: Jul. 14, 1998

[54] GRAVITY CONCENTRATED CARBON DIOXIDE FOR PROCESS

[75] Inventors: James L. Bowzer, Houston, Tex.; Douglas E. Kenyon, Littleton, Colo.; Eugene E. Wadleigh, Midland, Tex.

[73] Assignee: Marathon Oil Company, Findlay, Ohio

[21] Appl. No.: 779,855

[21] Appl. No.:

[22] Filed: Jan. 3, 1997

[22] Filed:

[51] Int. Cl.[6] ..... E21B 43/16; E21B 43/18

[52] U.S. Cl. ..... 166/252.1; 166/266; 166/402

[58] Field of Search ..... 166/252.1, 252.2, 166/252.4, 266, 267, 268, 401, 402, 306

[56] References Cited

U.S. PATENT DOCUMENTS

| | | | |
|---|---|---|---|
| 2,623,596 | 12/1952 | Whorton et al. | 166/402 |
| 3,653,438 | 4/1972 | Wagner | 166/266 |
| 3,788,398 | 1/1974 | Shephard | 166/401 X |
| 4,040,483 | 8/1977 | Offeringa | 166/401 |
| 4,042,029 | 8/1977 | Offeringa | 166/401 |
| 4,513,821 | 4/1985 | Shu | 166/402 |
| 4,589,486 | 5/1986 | Brown et al. | 166/252.1 |
| 4,628,999 | 12/1986 | Kiss et al. | 166/402 |
| 4,733,724 | 3/1988 | Cardenas et al. | 166/263 |
| 5,232,049 | 8/1993 | Christiansen et al. | 166/401 X |
| 5,314,017 | 5/1994 | Schechter et al. | 166/252.3 |
| 5,503,226 | 4/1996 | Wadleigh | 166/306 X |

OTHER PUBLICATIONS

J. P. O'Leary, Timothy J. Murray, Terry Guillory, Craig Grieve, Mitchell C. Reece, Mark Nugent, Tom Perkins, Paul B. Crawford, "Nitrogen–Driven $CO_2$ Slugs Reduce Costs," *Petroleum Engineer International*, (May 1979), pp. 130–140.

*Primary Examiner*—George A. Suchfield
*Attorney, Agent, or Firm*—Jack L. Hummel; Jack E. Ebel

[57] ABSTRACT

This invention relates to the recovery of oil from an oil-bearing formation having a natural fracture network with substantial vertical communication and wherein gravity drainage is the primary means of recovery. A downwardly inflating gas-cap is pressured up with a chase gas having a density less than that of $CO_2$. $CO_2$ is injected and a $CO_2$-rich displacing slug is formed at the gas-liquid hydrocarbon contact. The chase gas is injected to facilitate displacing downwardly the $CO_2$-rich displacing slug to recover hydrocarbon from the reservoir. $CO_2$ is replaced in the displacing slug as the $CO_2$ is solubilized into the oil, including matrix oil, to facilitate recovery thereof. The oil is recovered through production wells in fluid communication with the reservoir, preferably the inlet to the well is below the water-liquid hydrocarbon contact at such a level to prevent free-gas production. The chase gas has a density less than that of the $CO_2$ and is comprised mostly of nitrogen; however, it can contain other gases such as methane, ethane, $CO_2$, and miscellaneous gases. The chase gas is injected at a rate to minimize mixing of the chase gas with the $CO_2$ and to facilitate gravity segregation of the $CO_2$ from the chase gas. The $CO_2$ in the $CO_2$-rich displacing slug can be replenished by incorporating $CO_2$ into the chase gas and permitting the $CO_2$ to gravity segregate downwardly while the less dense gases move upwardly.

10 Claims, 3 Drawing Sheets

GRAVITY CONCENTRATED CARBON DIOXIDE FOR PROCESS

FIELD OF THE INVENTION

This invention relates to a process of recovering oil from an oil-bearing formation having a natural fracture network with vertical communication and wherein gravity drainage is the primary means for recovery. Carbon dioxide is concentrated in a displacing slug at the gas-liquid hydrocarbon contact and the slug is displaced downwardly to facilitate the recovery of hydrocarbon or oil through a production well in fluid communication with the formation. A chase gas having a density less than the $CO_2$, e.g., comprised mostly of nitrogen, is used to propagate the $CO_2$ in the reservoir to recover hydrocarbon therefrom. Hydrocarbon and oil are used interchangeably in this invention.

DESCRIPTION OF RELATED ART

The oil industry has recognized the benefits of enhanced oil recovery using $CO_2$ to miscibly and immiscibly displace oil or hydrocarbon from a subterranean reservoir. Advantages of using $CO_2$ include solubilization of the $CO_2$ in the oil to swell it and reduce its viscosity and interfacial tension. However, the use of $CO_2$ for this purpose is expensive. Gases to displace and propagate the $CO_2$ displacement slug through the reservoir have been tried as a means of reducing costs, such has generally met with failure due to early breakthrough of the displacing gas into the $CO_2$-enriched zone resulting in bypassing the oil and thus poor oil recovery.

$CO_2$ flooding of heterogenous reservoirs is particularly difficult. The injected $CO_2$ flows very easily in highly permeable zones or fractures of such reservoirs resulting in early breakthrough of the injected gas and poor sweep efficiency. Such flooding has generally required extensive recycling of the injected $CO_2$ gas. To overcome early breakthrough, mobility control agents have been tried in conjunction with the $CO_2$, but results have not been encouraging.

Flooding of homogeneous reservoirs has been more successful since a $CO_2$ "stabilized" frontal displacement of the hydrocarbon can occur in such reservoirs. The $CO_2$ is preferably injected under reservoir conditions to cause the $CO_2$ to flow through the reservoir as a stabilized displacement front. When the $CO_2$ encounters highly permeable channels in the reservoir, the $CO_2$ tends to channel thru the permeable channels bypassing the oil as it would do in a heterogenous reservoir. The extreme of this situation is fractured reservoirs in which highly permeable fractures co-exist with low permeability matrix zones of the formation. $CO_2$ and water have been intermittently injected to reduce the mobility of the $CO_2$ in such situations, this combination has met with limited success. Foam has also been used with the $CO_2$ to try and reduce the mobility but again only with limited success.

The following prior art is representative of the patent literature:

U.S. Pat. No. 5,314,017 to Schecter, et al., proposes the use of $CO_2$ in a vertically fractured reservoir to enhance gravity drainage of hydrocarbon into the vertical fractures. The $CO_2$ rises into the liquid-filled fractures and saturates the fractures with $CO_2$ to mobilize the oil. The $CO_2$ lowers the interfacial tension between the gas and the hydrocarbon in the formation matrix adjacent the vertical fractures to cause drainage of the oil into the fracture system. If early breakthrough of the $CO_2$ into a producing well occurs, the injection rate of the $CO_2$ is reduced.

U.S. Pat. No. 4,513,821 to Shu teaches lowering the minimal miscibility pressure of the $CO_2$ with respect to hydrocarbon within a reservoir by injecting and displacing a coolant through the reservoir until the temperature of the reservoir corresponds to a predetermined temperature at which $CO_2$ minimum miscibility pressure occurs. Thereafter, $CO_2$ is injected and displaced through the formation to recover the hydrocarbon therefrom.

U.S. Pat. No. 4,589,482 to Brown, et al., teaches first determining the critical concentration of various crude oil components in $CO_2$ to achieve first contact miscibility with the crude oil and thereafter injecting into the formation a displacement slug comprised of $CO_2$ and the preselected crude oil components. The slug is displaced through the reservoir to recover oil therefrom.

O'Leary, et al., in "Nitrogen-Driven $CO_2$ Slug Reduce Cost," Petroleum Engineering International, May 1987, teaches the use of nitrogen to displace a $CO_2$ slug through a horizonal reservoir core sample to recover crude oil therefrom. The article teaches that nitrogen costs less than $CO_2$ and the formation volume factor of nitrogen is three times as great as the $CO_2$.

The oil industry is in need of a less costly, more efficient $CO_2$ process to recover oil from subterranean reservoirs. Such is possible with a gravity drainage reservoir having vertical communication. $CO_2$ is concentrated within a zone or bank at the displacement front and a low-cost less dense chase gas is used to 1) propagate downwardly the $CO_2$-enriched displacing slug through the hydrocarbon bearing formation and 2) to provide primary reservoir replacement for voidage caused by the displacement of the hydrocarbon. Gravity segregation of $CO_2$ from the lighter chase gas such as nitrogen can be used to maintain a stable $CO_2$ enriched zone.

Using an inexpensive chase gas to propagate $CO_2$ through a horizontal core saturated with oil was found successful in laboratory experiments, e.g., the above O'Leary, et al. reference, however such technology has generally met with unsuccessful results in the field. The chase gas readily fingers through the $CO_2$ and hydrocarbon, especially when the core sample is saturated with viscous hydrocarbon, bypassing the $CO_2$ without propagating it through the reservoir. These laboratory studies failed to recognize the potential for the use of a chase gas to 1) segregate from $CO_2$ in vertical equilibrium, gravity drainage applications, and 2) to serve as a less costly gas to pressure up the reservoir while also propagating downwardly the $CO_2$-rich displacing slug for hydrocarbon displacement purposes. As proposed in this invention, the chase gas remains largely segregated from the $CO_2$ by gravity as the $CO_2$ propagates slowly downwardly in a substantially static condition, mobilizing hydrocarbon as it goes. The chase gas replaces the voidage caused by displacement of the hydrocarbon or oil and pressures up the reservoir to displace downwardly the $CO_2$-rich displacing slug.

This invention uses a $CO_2$-enriched displacement slug to recover hydrocarbon from a hydrocarbon-bearing formation having a natural fracture network with vertical communication. The $CO_2$-enriched displacing slug forms under gravity segregation at the gas-liquid hydrocarbon interface in the formation. A chase gas having an average density less than that of $CO_2$ is injected, permitted to gravity segregate from the $CO_2$, and sufficient pressure is applied via the chase gas to displace downwardly the $CO_2$-rich displacing slug through the hydrocarbon bearing formation. Hydrocarbon is recovered through a production well in fluid communication with the formation.

Thus, it is an object of this invention to provide a process wherein $CO_2$ and a gas of lesser density is used to displace the $CO_2$ in a vertically fractured reservoir to improve oil recovery at a much lower $CO_2$ requirement than in previously known processes.

It is another object of this invention to maximize the value of minimizing $CO_2$ requirements necessary to recover the hydrocarbon.

Another object of the invention is to provide for the efficient application of $CO_2$ displacement in fractured reservoirs wherein the prior art has failed due to excessive gas recycling and inefficient $CO_2$ utilization.

Another object of the process is to encourage a uniform displacement of a $CO_2$-rich displacing slug laterally to all production wells within a designated inflated gas-cap area.

Another object is to provide production completions below the maximum matrix hydrocarbon saturation wherein gas injection is applied to lower the fluid contacts and supply matrix-released hydrocarbon to the producers. Chase gas is injected to increase reservoir pressure as required to minimize the water recycle from production wells. Produced water is replaced by downwardly moving hydrocarbon which in turn is replaced by the chase gas. Since the system is gravity dominated, vertically segregating gases move slowly in the fracture network.

Also, it is an object of the invention to provide a process that allows the $CO_2$ to congregate in the highly hydrocarbon-saturated zone immediately above the moving gas-hydrocarbon contact so that the $CO_2$ can process the hydrocarbon to improve the mobility or drainage of the hydrocarbon into the descending hydrocarbon column.

SUMMARY OF THE INVENTION

This invention provides a process for recovering hydrocarbons from a hydrocarbon-bearing formation having a natural fracture network with vertical communication. A $CO_2$-rich displacing slug is established at the gas-liquid hydrocarbon contact and a chase gas is injected to pressure up the reservoir to propagate downwardly the displacing slug in the reservoir to recover hydrocarbon. A production well is located below the hydrocarbon-water contact within the formation to withdrawthe hydrocarbon or oil. The primary means for producing the hydrocarbon from the reservoir is gravity drainage. The chase gas can be any cheap gas having a density less than that of the $CO_2$. Sufficient chase gas is injected to pressure-up the reservoir to maintain a driving force sufficient to displace the $CO_2$-rich slug and to occupy the voidage created by the displaced hydrocarbon. Injection rates of the chase gas and reservoir conditions are monitored to segregate the chase gas from the $CO_2$ and to accumulate the chase gas above the $CO_2$-enriched slug. A "static" gas-cap is preferably maintained in the reservoir, i.e., the gas-cap shows very little change or movement, after the process is initiated. Wells within the formation can be used to monitor the level of the gas-liquid hydrocarbon contact, the concentration of $CO_2$ at the gas-liquid hydrocarbon contact, the liquid hydrocarbon-water contact, the pressure and temperature of the formation, etc., to obtain optimum production conditions of the hydrocarbon. The hydrocarbon or oil is produced through the production wells at such rates and from such a depth that substantially no free gas breakthrough is permitted at the inlet to the production wells.

BRIEF DESCRIPTION OF THE DRAWINGS

The accompanying drawings illustrate embodiments of the present invention and, together with the description, serve to explain the principles of the invention.

In the drawings.

DESCRIPTION OF THE PREFERRED EMBODIMENTS

Reservoirs applicable to this process include those that have a significant structural relief intersected by a natural fracture network with vertical communication. Preferably the reservoir is a thick formation and the vertical communication is substantial. The reservoirs preferably have a gas-cap which provides for hydrocarbon capture and hydrocarbon withdrawal below the gas-cap. The gas-cap should be sufficiently thick to achieve or permit the desired composition of separation or segregation of the gas components within the fractures of the gas-cap. That is, the gas-cap should have sufficient height to permit the necessary gravity segregation of the more dense $CO_2$ from the less dense chase gas components. If the reservoir does not have a gas-cap or has a small initial gas-cap, sufficient $CO_2$ can first be injected to create a secondary gas-cap of enriched $CO_2$. As the $CO_2$ is used in the displacing/processing of the oil, a gas cap is formed above the $CO_2$-rich gas phase. For example, a stable propagating bank of $CO_2$-rich displacing fluid can first be obtained and thereafter as the $CO_2$-rich gas displacing slug is propagated downwardly, chase gas can be injected to create a gas-cap and pressure up the reservoir to displace downwardly the $CO_2$-rich gas phase.

Figure 1:
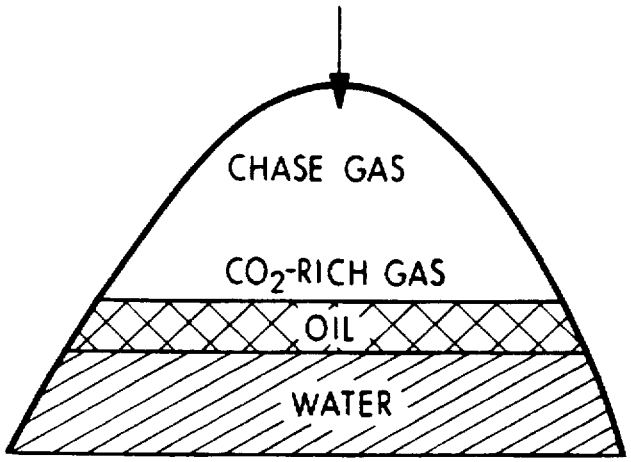
FIG. 1 represents a reservoir with a downwardly inflating gas-cap. A chase gas is injected and gravity segregates above the more dense $CO_2$. Any $CO_2$ is concentrated in the $CO_2$-rich gas phase located at or above the gas-liquid hydrocarbon contact. Further, injection of the chase gas gradually expands the gas-cp causing oil displacement by the $CO_2$-rich gas phase and movement of the water phase to a lower elevation, the combination exposes fresh matrix oil to the $CO_2$ and the expanding gas-cap. The water phase is displaced to an aquifer in fluid communication with the reservoir or is withdrawn for disposal elsewhere.
Figure 2:
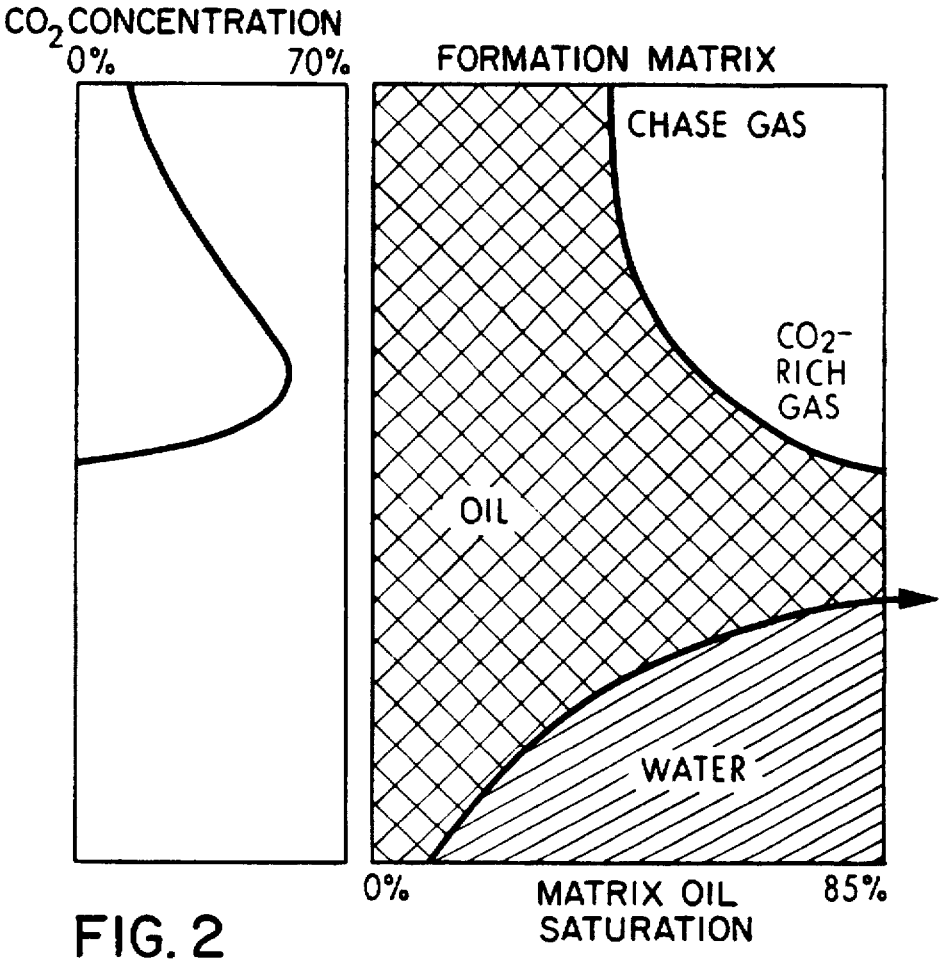
FIG. 2 represents a profile of the $CO_2$ concentration in the matrix of the formation. The $CO_2$ concentration is higher in the $CO_2$-rich gas phase as it approaches the gas-liquid hydrocarbon contact. The $CO_2$ concentration diminishes as it is solubilized into the oil or liquid hydrocarbon. The gas phase, which is composed mostly of a chase gas such as nitrogen displaces downwardly the $CO_2$-rich gas phase in the formation. The chase gas is less dense than the $CO_2$ and segregates from the $CO_2$ to the top of the formation. The dense $CO_2$-rich gas phase diffuses into the matrix to mobilize and cause drainage of the oil by swelling the oil and reducing its viscosity. The chase gas phase builds pressure in the gas cap to lower the liquid levels and to position the $CO_2$-rich gas phase contiguous to the fresh oil.
Figure 3:
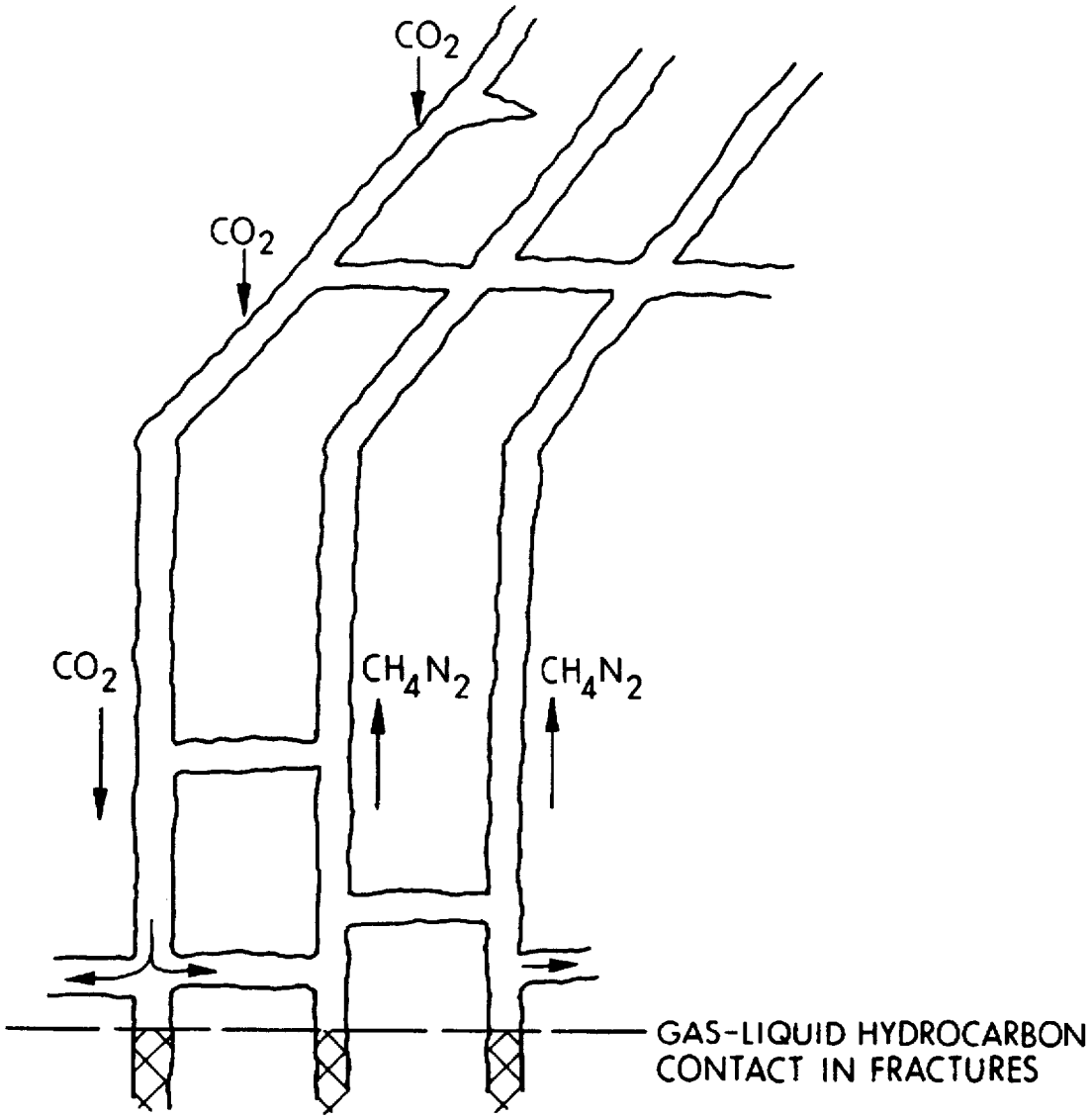
FIG. 3 is a conceptual representation during $CO_2$ injection into an existing gas-cap which contains nitrogen ($N_2$) and methane ($CH_4$). The more dense $CO_2$ segregates to the bottom while the less dense nitrogen and methane segregate to the top. The $CO_2$ concentrates at the gas-liquid hydrocarbon contact in the fractures.
Figure 4:
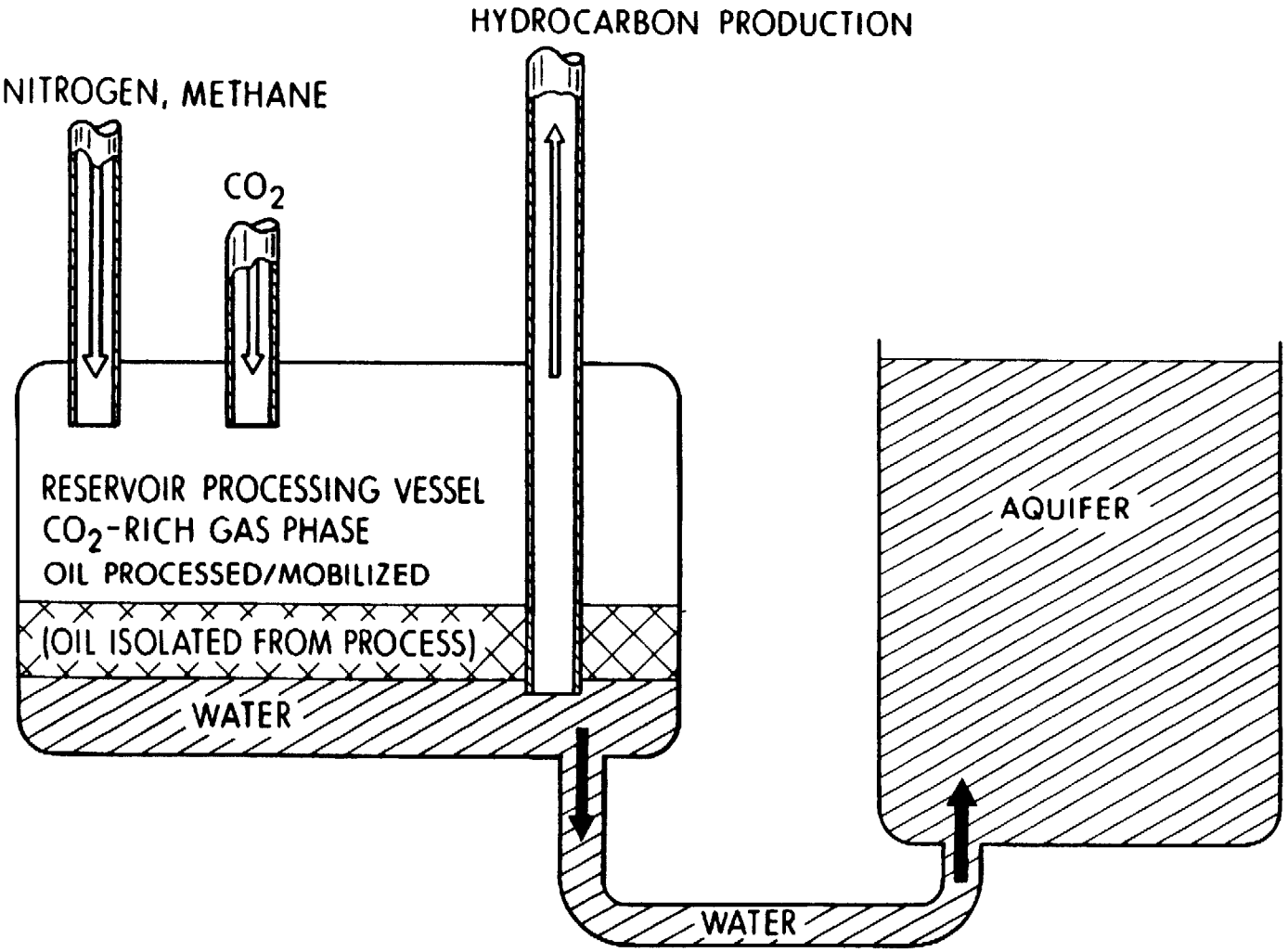
FIG. 4 represents respective flows of the fluids in a reservoir wherein nitrogen and methane are injected as the chase gas. $CO_2$ is injected when needed to replenish the $CO_2$ in the $CO_2$-rich gas phase that has been solubilized into the oil. Hydrocarbon or oil is withdrawn from the formation. Sufficient chase gas is injected to facilitate displacement of the $CO_2$-rich gas phase into the matrix to process or mobilize the oil. Oil is displaced and withdrawn below the oil-water contact at a point to isolate the oil or hydrocarbon to the production well from free gas production. Water is displaced into an aquifer.

A $CO_2$-enriched zone in a reservoir having an existing gas-cap can be created by convection induced by density contrast between in-place gases in the fractures and injecting $CO_2$, e.g., FIG. 3. The key to establishing a $CO_2$-enriched zone at the base of an existing gas-cap is the tendency for natural fractures to act as vertical flow guides that provide relative separation and containment of the inplace and injected gases. Guided by fractures, the $CO_2$ moves downwardly by gravity through a plume-like motion. The $CO_2$ is concentrated via a vertical plume migrating toward the base of the gas-cap while the lighter in-place gases, e.g., methane and/or nitrogen and/or other lighter gases, are forced upwardly to the top of the gas-cap in convective flow and upward moving plumes. Fractures form a lattice-work to make a natural network segregating upwardly and downwardly moving plumes. The $CO_2$ plume moves downwardly then spreads laterally over the liquid contact area in the fractures. Counter-flow plumes of low density gases flow outwardly along the base of the gas-cap and upwardly as governed by fractures and localized mixing with the $CO_2$.

The desired concentration of $CO_2$ in the $CO_2$-rich displacing slug depends on the conditions of the reservoir, including the pressure and the temperature, and the composition of the crude oil or hydrocarbon within the reservoir. For example, $CO_2$ swelling of oil increases as the $CO_2$ concentration increases. Maximum $CO_2$ concentration in the slug provides the greatest benefit, increased reservoir pressure increases $CO_2$ solubility and lowering the reservoir temperature also increases solubility of the $CO_2$ in the oil. However, at lower pressures (such as 500 psig), the solubility of $CO_2$ will be very sensitive to the displacing slug concentration. The following table illustrates for example the reduction in oil swelling for a typical 30° API oil at 75° and 500 psig pressure. Table values are percent change in oil phase volume at specified $CO_2$ concentrations (by column) and nitrogen concentrations (by row). The remaining concentration is methane. For example, oil swelling percentages for a mix of 20% methane are underlined and vary with the blend of nitrogen and carbon dioxide making up the remaining 80%.

Reservoir Oil Volume Change (%) as a Function of Processing Gas Composition

| | $CO_2$ Concentration | | | | | |
|---|---|---|---|---|---|---|
| $N_2$ Concentration | 0% | 20% | 40% | 60% | 80% | 100% |
| 0% | 0.4 | 1.3 | 2.2 | 3.3 | 4.6 | 6.1 |
| 20% | −0.2 | 0.6 | 1.4 | 2.3 | 3.4 | |
| 40% | −0.7 | 0.0 | 0.7 | 1.5 | | |
| 60% | −0.2 | −0.5 | 0.1 | | | |
| 80% | −1.6 | −1.0 | | | | |
| 100% | −2.0 | | | | | |

The table demonstrates that any increase in displacing slug $CO_2$ concentration increases swelling of the oil. Increased oil swelling generally lowers oil viscosity contributing to oil mobility and migration of the oil to a production well. The mobilized oil movement parallels that of the descending $CO_2$-rich slug. $CO_2$ solubility in oil increases with pressure and decreases with increased temperature for a given composition of $CO_2$ displacing slug.

The concentration of $CO_2$ in the $CO_2$ displacing slug is enhanced by minimizing interaction between the upward and downward moving gas plumes. For example, gaseous $CO_2$ is preferably injected into the lower portion of the existing gas-cap and chase gas is preferably injected into the top portion of the gas-cap. This minimizes the interaction between the chase gas and the $CO_2$ and facilitates density segregation of the gases. The $CO_2$ is preferably injected into the highest density of the $CO_2$-rich displacing slug under prevailing reservoir conditions. Injection of the $CO_2$ and chase gas is preferably regulated to minimize intermixing between the two. Preferably a substantially static progression, i.e., showing little change or movement or progression, is established when injecting the chase gas and displacing the $CO_2$-rich displacing slug.

The production of hydrocarbons from the reservoir is preferably obtained by placing the inlet to the production well below the water-hydrocarbon liquid contact at such a level to reduce or eliminate free gas production. This prevents total unloading of the liquids from the tubing tail in the production well to maintain a liquid obstruction to free gas production. The $CO_2$-rich displacing slug displaces downwardly the hydrocarbon and, as a result, the water-hydrocarbon contact is also lowered. Production well completions are deepened as the process progresses for liquid withdrawal beneath the inflating gas-cap, with wells located below the gas cap, or in flank wells with no gas cap, as dictated by reservoir shape. Production completions are positioned with tubing and bottom hole perforations (preferably open holes) penetrating the liquid column sufficiently to avoid free gas production. This mode of operation is critical to establish and maintain a $CO_2$-rich slug that is not diluted by subsequent chase gas injection.

The desired downward movement of the $CO_2$-enriched zone may require increased gas cap pressure, net water production and water disposal, or both. The preferable gas cap pressure is therefore an economic trade-off between the costs associated with increased gas cap pressure and provision for net water production and water disposal. Few pressure observation points are required to monitor general changes in gas-cap pressure. Liquid levels and/or pressures can be monitored in the producing wells (pumping or flowing respectively) to quantify the height of liquid "seal" remaining before vertical gas breakthrough. Alternately, the liquid rate can be increased until there is slight production of gas at rates above the estimated solution gas volume, then reducing the liquid withdrawal slightly. As the process matures and liquid head is diminished, the individual well liquid rate will also reduce until deepening of the completion is warranted. Completion of several producing wells at staggered depths enhances stability in oil withdrawal capacity as the process advances from high elevations downward. Good completion connection to a reservoir's natural fracture network or process application in a high permeability reservoir provides both high liquid production and cooperative interference opportunities when there are multiple withdrawal points beneath the descending gas front. Liquid lateral flow capacity is sufficient to maintain a near horizontal gas-liquid interface beyond the locally depleted liquid level near a liquid withdrawal point (producing well). The high lateral flow capacity allows the process to be managed as two distinct segments: 1) the vertical gas processing of oil above the gas-liquid interface, and 2) the strategic horizontal capture of oil at elevations beneath the gas-liquid interface that provide optimum production without producing the $CO_2$-enriched gas.

For reservoirs with limited or no initial gas-cap at the initiation of the process, the combination of liquid withdrawals and injection of pure $CO_2$ or of gas containing increased $CO_2$ concentrations results in the growth of a secondary gascap with additional $CO_2$ content. $CO_2$ concentration at the $CO_2$-rich gas zone slowly increases via gravity segregation with a developing gas-cap gas mixture.

For reservoirs with a substantial initial gas-cap with or without $CO_2$ at the initiation of the process, $CO_2$ injection forms gravity plumes. The $CO_2$ accumulates at the base of the gas-cap, forming a $CO_2$-rich gas zone while pushing upwardly in counterflow plumes lower molecular weight gases such as methane, nitrogen, etc.

This process encourages water production from the reservoir while expanding the gas saturated pore volume within the reservoir. The water is displaced into an aquifer or away from the immediate reservoir.

The reservoir preferably has a thick gas-cap to provide for additional segregation of gas components in a nearly static-condition. Also, a thick gas-cap tends to counteract the mixing and/or diffusion of the gases and thus enhances the desired segregation of the gas components.

As mentioned earlier, the $CO_2$ in the $CO_2$-rich displacing slug needs to be All replenished as the $CO_2$ is solubilized and/or diffused into the hydrocarbon or crude oil. Replenished $CO_2$ can be accomplished by injecting pure $CO_2$ as a liquid or gas or combination thereof or a gas composition comprised of $CO_2$. For example, the $CO_2$ can be present in the chase gas, the $CO_2$ is permitted to gravity segregate (enriching the $CO_2$-rich displacing slug) from the less dense chase gas components. Replenishment is preferably accomplished through an injection well having an outlet close to the $CO_2$-rich gas zone.

The reservoir is preferably operated to promote reservoir conditions that do not facilitate mixing of the $CO_2$ and chase gas. Such conditions should encourage segregation of the gases, e.g., where $CO_2$ and chase gas are injected simultaneously, to create a $CO_2$-rich zone near the $CO_2$ gas-liquid hydrocarbon contact and a less dense chase gas composition above the $CO_2$-rich zone. The rate of formation of the $CO_2$-rich displacing zone or slug can be controlled by the gas composition, temperature and pressure of the reservoir and fracture properties of the reservoir. For example, heated chase gas containing $CO_2$ can promote the development of the $CO_2$-enrichment zone by inducing enhanced buoyancy separation of gas components, and by thermal diffusion effects wherein the heavier $CO_2$ molecules seek out a colder zone while the lighter molecular weight molecules such as nitrogen and methane tend to migrate to the top of the gas-cap. But, higher temperatures may also have an adverse affect on the rate of $CO_2$ solubilization into the liquid hydrocarbon.

Chase gas can be any cheap gas that has a density substantially less than that of the $CO_2$ gas. The chase gas is preferably less compressible than the $CO_2$ during the injection. Examples of chase gases include nitrogen, methane, ethane, combustion gases or flue gases, air, mixtures thereof, or any like or equivalent combination. The chase gas can contain $CO_2$, the $CO_2$ is preferably in small concentrations. Examples of compositions of chase gas include about 0% to about 20% and preferably about 0% to about 10% by volume of $CO_2$, about 0% to about 99% and preferably about 80% to about 99% by volume of $N_2$, about 0% to about 99% and preferably about 0% to about 40% by volume of methane, and about 0% to about 5% and preferably about 0% to about 3% by volume of miscellaneous gas components such as ethane, propane, other lower molecular weight hydrocarbons, carbon monoxide, hydrogen sulfide and combinations thereof. The need to dispose of certain gases may increase the concentrations of such gases in the chase gas, e.g., the concentrations of hydrogen sulfide and/or carbon monoxide may exceed the 5% by volume if it is necessary to dispose of these gases.

As the process progresses, the downwardly movement of the gashydrocarbon contact exposes more of the oil saturated matrix to the $CO_2$-enriched gas zone. The $CO_2$ tends to mix and solubilize into the matrix oil to reduce its viscosity, the result causes movement of the hydrocarbon or oil into the fractures and then toward the production well. The oil or hydrocarbon drainage from the matrix to the fractures is replaced by a counterflow of the $CO_2$-enriched gas phase, causing the expected benefits of the $CO_2$ on the fresh matrix oil and subsequent and additional drainage of the matrix oil into the fractures.

$CO_2$ in the produced gas from the reservoir can be recovered and reinjected to maintain the accumulated $CO_2$ volume for reservoir processing as the "layer" of the $CO_2$-rich displacing slug advances vertically down the formation. Preferably the $CO_2$ is separated from the produced oil or hydrocarbon and recycled back into the process. Higher molecular weight hydrocarbons such as ethane, propane and other natural gas liquids can be removed from the produced gas by surface processing and marketed, the methane, nitrogen, and other less dense gases (compared to $CO_2$) can be injected back into the reservoir as chase gas. However, selected higher molecular weight hydrocarbons can be incorporated into injected gases to combine with the $CO_2$ to enhance or increase oil viscosity reduction and to increase solubilization of the $CO_2$ into the matrix oil to facilitate recovery of the hydrocarbon. In the extreme cases where pressure, temperature, etc. allow, the $CO_2$ may approach miscibility with the oil, but the process does not require miscibility between $CO_2$ and oil.

The desired thickness of the $CO_2$-enriched zone can be determined by a gas-cap pressure survey based on data obtained from wells monitoring the reservoir. Ideally, a minimum thickness of a maximum concentration $CO_2$ slug is used. Monitoring the attained profile of $CO_2$ concentration as it is advanced downwardly in the reservoir can be performed as dictated by reservoir shape. In fractured formations of high vertical thickness, static high resolution pressure surveys can be performed to measure the density profile of the static gas column. $CO_2$ concentration can be roughly estimated from the density of the total gas column ($CO_2$ is over twice the density of other gases of significant presence in typical gas caps). Densities of the $CO_2$-enriched zone approach that of $CO_2$ under reservoir pressure conditions. The $CO_2$ slug should have a thickness sufficient to allow adequate time for optimum oil processing and mobilization, typically a 25' to 50' thick slug would allow 2 to 5 years of process duration at gas-hydrocarbon contact lowering rates of between 5' and 20' per year. Concentration of the $CO_2$ in the $CO_2$ displacing slug should be about 50% to about 90% and preferably about 70% to 90% by volume. Typically concentrations above 90% will be unattainable due to mixing with gas components of the reservoir oil.

An alternate technique applicable in thick or thin reservoirs is to temporarily increase liquid withdrawal to allow free gas entry or production. Knowing the solution gas-oil ratio and composition, the free gas rate and composition can be calculated. A multi point rate and composition test procedure will provide definition of the gas-cap composition profile. The maximum $CO_2$ concentration can be estimated using either technique to determine need for additional $CO_2$ injection for maintaining process effectiveness. The thickness of the $CO_2$-rich displacing slug is not as important as its maximum $CO_2$ concentration. The maximum concentration will determine the degree of oil processing or $CO_2$ solubilizing into the oil to facilitate recovery thereof.

The reservoir preferably contains wells to monitor the water-oil contact, the gas-liquid oil or hydrocarbon contact, the $CO_2$-enriched displacement zone, the pressure and temperature of the reservoir, etc. Appropriate measurements are taken via the monitor wells and the data are used to optimize process conditions. Preferably the monitoring wells are placed uniformly throughout the reservoir to obtain an accurate profile of the reservoir conditions.

The following example demonstrates the practice and utility of the invention. The invention is not to be construed or limited by the scope of the example.

EXAMPLE 1

A naturally fractured reservoir having vertical communication is produced by gravity drainage. A downwardly inflating gas-cap and an aquifer below the water-oil contact facilitate the production of oil. A $CO_2$-rich displacing slug at and above the gas liquid hydrocarbon contact is initiated by injecting $CO_2$ through an injection well. Thereafter, a chase gas consisting of 80 volume % $N_2$, 8 volume % $CO_2$, 10 volume % $CH_4$ and 2 volume % of miscellaneous gases is injected into the reservoir to maintain a pressure sufficient to displace downwardly the $CO_2$-rich displacing slug in a substantially static condition. The $CO_2$, $CH_4$ and miscellaneous gases are obtained from processing oil or hydrocarbon produced from the reservoir. Injection rates, pressure and temperature are regulated such that the chase gas does not substantially mix with the $CO_2$-rich displacing slug. The $CO_2$ in the chase gas and $CO_2$ evolving from the processed oil combine to establish a trailing edge $CO_2$ compositional gradient that minimizes dilution of the $CO_2$-rich displacing slug. The concentration of $CO_2$ in the $CO_2$-rich displacing slug is maintained within the range of about 50% to about 80% by volume. Wells within the reservoir are used to monitor reservoir conditions and data therefrom are used to determine reservoir pressure, temperature, etc. which in turn are used to design and maintain the desired process conditions.

$CO_2$ in the $CO_2$-rich displacing slug is replenished via injection wells to maintain the desired $CO_2$ concentration. The $CO_2$ is solubilized into the oil to mobilize it into the fractures and thereafter to the production wells. Inlets to production wells are maintained below the water-liquid hydrocarbon contact to create a seal against the production of free gas. Oil or hydrocarbon is produced through the production wells.

The preferred embodiments and principles of the invention and methods of operation have been described in the foregoing specification. The invention is not to be construed or limited by the particular embodiments disclosed herein. Rather, the embodiments are to be regarded as illustrative and not restrictive. Variations and changes may be made without departing from the spirit of the present invention and all variations and changes which fall in the spirit and scope of the invention as defined herein are intended to be embraced by the scope of the invention.

What is claimed is:

1. A process for recovering hydrocarbon from a hydrocarbon-bearing formation having a natural fracture network with vertical communication, a gas-liquid hydrocarbon contact and a liquid hydrocarbon-water contact within the formation, and wherein the primary means for producing the hydrocarbon from the formation is gravity drainage and wherein the formation has at least one injection well in fluid communication with at least one production well, comprising:

a) injecting $CO_2$ into the formation via the injection well to establish a $CO_2$-rich displacing slug at about the gas-liquid hydrocarbon contact, b) injecting via the injection well a chase gas having a density less than that of the $CO_2$, and permitting the chase gas to segregate from and above the $CO_2$ to obtain a gas-cap comprised of $CO_2$ gas at the bottom of the gas cap and the chase gas at the top of the gas cap, c) maintaining the chase gas at a sufficient pressure in the gas-cap to drive downwardly the $CO_2$-rich displacing slug, to displace the hydrocarbon toward the production well, and d) recovering hydrocarbon from the production well.

2. The process of claim 1 wherein the chase gas is comprised of nitrogen, methane or a mixture of nitrogen and methane, or a mixture of nitrogen, methane, and $CO_2$.

3. The process of claim 1 wherein the chase gas is injected into the gas-cap at a rate sufficient to maintain the gas-cap in a substantially static condition and to substantially minimize mixing of the chase gas with the $CO_2$ in the $CO_2$-rich displacing slug.

4. The process of claim 1 wherein the $CO_2$ is injected intermittently into the formation to enrich the $CO_2$-rich displacing slug as the $CO_2$ is solubilized into the hydrocarbon.

5. The process of claim 1 wherein the formation has at least one observation well equipped to periodically monitor the depth of the gas-liquid hydrocarbon contact, the liquid hydrocarbon-water contact, the composition of the gas-cap and the pressure and temperature of the reservoir.

6. The process of claim 1 wherein sufficient pressure is maintained in the gas-cap to facilitate solubilization of the $CO_2$ in the hydrocarbon.

7. The process of claim 1 wherein the process conditions and production of hydrocarbon from the reservoir cause the hydrocarbon-water contact to move downwardly in a substantially static progression.

8. The process of claim 1 wherein the hydrocarbon is withdrawn from the formation at a location below the liquid hydrocarbon-water contact at a rate such that substantially no gas breakthrough occurs at the inlet to the production well.

9. The process of claim 1 wherein the chase gas is comprised of about 0% to about 99% by volume of $N_2$ and about 0% to about 20% by volume of $CO_2$.

10. The process of claim 1 wherein the chase gas is comprised of about 0% to about 20% by volume of $CO_2$, about 0% to about 99% by volume of $CH_4$, about 0% to about 99% by volume of $N_2$ and about 0% to about 5% by volume of miscellaneous gas components.

* * * * *

UNITED STATES PATENT AND TRADEMARK OFFICE

CERTIFICATE OF CORRECTION

PATENT NO. : 5,778,977

DATED : July 14, 1998

INVENTOR(S) : James L. Bowzer, Douglas E. Kenyon, and Eugene E. Wadleigh

It is certified that error appears in the above-indentified patent and that said Letters Patent is hereby corrected as shown below: On the title page: Item [54]

Title, line 2 : Delete "FOR" and insert --EOR--.
Col. 1, line 2 : Delete "FOR" and insert --EOR--.

Col. 2, line 34 : Following "$CO_2$" insert -- - --.
Col. 4, line 7 : Delete "gas-cp" and insert --gas-cap--.
Col. 5, line 51 : Delete "4.6" and insert --4.6--.
Col. 5, line 52 : Delete "2.3" and insert --2.3--.
Col. 5, line 53 : Delete "0.7" and insert --0.7--.
Col. 5, line 54 : Delete "-0.5" and insert ---0.5--.
Col. 5, line 55 : Delete "-1.6" and insert ---1.6--
Col. 7, line 20 : Following "to be" delete "ATT".
Col. 8, line 4 : Delete "gashydrocarbon" and insert --gas-hydrocarbon--.

Signed and Sealed this

Second Day of March, 1999

Q. Todd Dickinson

Attest:

Q. TODD DICKINSON

Attesting Officer

Acting Commissioner of Patents and Trademarks